US011768466B2

(12) United States Patent
Kaelin

(10) Patent No.: US 11,768,466 B2
(45) Date of Patent: Sep. 26, 2023

(54) MECHANISM FOR ADJUSTING A TIMEPIECE BRIDGE

(71) Applicant: ETA SA MANUFACTURE HORLOGÈRE SUISSE, Grenchen (CH)

(72) Inventor: Laurent Kaelin, Sonvilier (CH)

(73) Assignee: ETA SA MANUFACTURE HORLOGÈRE SUISSE, Grenchen (CH)

( * ) Notice: Subject to any disclaimer, the term of this patent is extended or adjusted under 35 U.S.C. 154(b) by 304 days.

(21) Appl. No.: 17/060,496

(22) Filed: Oct. 1, 2020

(65) Prior Publication Data

US 2021/0157270 A1 May 27, 2021

(30) Foreign Application Priority Data

Nov. 25, 2019 (EP) ..... 19211102

(51) Int. Cl.
*G04B 29/02* (2006.01)
*G04B 15/14* (2006.01)
*G04B 17/04* (2006.01)

(52) U.S. Cl.
CPC ..... *G04B 15/14* (2013.01); *G04B 17/045* (2013.01); *G04B 29/02* (2013.01)

(58) Field of Classification Search
CPC ..... G04B 15/14; G04B 17/045; G04B 29/02; G04B 29/04; F16B 43/00; F16B 43/009
See application file for complete search history.

(56) References Cited

U.S. PATENT DOCUMENTS 1,435,433 A * 11/1922 Triggs ..... F16B 5/06 123/65 R
4,256,211 A * 3/1981 Katkov ..... F16D 25/126 192/111.1
4,433,879 A * 2/1984 Morris ..... F16B 43/009 411/535

(Continued)

FOREIGN PATENT DOCUMENTS

CH 506116 A 12/1970
CH 705 087 B1 12/2012

(Continued)

OTHER PUBLICATIONS

European Search Report for EP 19211102 dated May 26, 2020.

*Primary Examiner* — Sean Kayes
(74) *Attorney, Agent, or Firm* — Sughrue Mion, PLLC

(57) ABSTRACT

A mechanism for adjusting a timepiece bridge fixed to a structure, including, coaxial and able to move one with respect to the other by sliding and/or rotation on a common axis, and returned one towards the other by an elastic return or clamping means, a first component fixed to the structure and a second component fixed to the bridge, the first component including a first relief facing a second relief that the second component includes, the first relief and the second relief having variable cooperation depending on the relative angular position between the first component and the second component, each the particular relative angular position defining a particular distance between reference surfaces of the first component and the second component.

12 Claims, 3 Drawing Sheets

(56) References Cited

U.S. PATENT DOCUMENTS

| | | | | | |
|---|---|---|---|---|---|
| 4,712,492 | A * | 12/1987 | Murray | A01C 7/203 | 403/3 |
| 4,916,836 | A * | 4/1990 | Baggio | A43B 5/0445 | 36/117.7 |
| 5,895,189 | A * | 4/1999 | Ruckert | F16B 5/0233 | 403/DIG. 1 |
| 8,439,456 | B2 * | 5/2013 | Kiechle | F16B 5/0233 | 411/546 |
| 2014/0369173 | A1 * | 12/2014 | Mertenat | G04B 35/00 | 368/318 |
| 2016/0201703 | A1 * | 7/2016 | Schwarzbich | F16B 5/0233 | 411/347 |

FOREIGN PATENT DOCUMENTS

| | | | |
|---|---|---|---|
| CH | 714 379 | A2 | 5/2019 |
| EP | 1 804 143 | A1 | 7/2007 |

* cited by examiner

MECHANISM FOR ADJUSTING A TIMEPIECE BRIDGE

CROSS REFERENCE TO RELATED APPLICATION

This application claims priority to European Patent Application No. 19211102.9 filed Nov. 25, 2019, the entire contents of which are incorporated herein by reference.

FIELD OF THE INVENTION

The invention relates to a mechanism for adjusting a timepiece bridge fixed to a structure, said adjustment mechanism including, coaxial and able to move with respect to each other by sliding along a common axis and/or in rotation with respect to said axis, which defines the adjustment direction, and returned towards one another by an elastic return means or pressed one against the other by a clamping means, a first component arranged to be fixed to said structure or to said bridge, and at least one second component arranged to be fixed to said bridge or respectively to said structure.

The invention also relates to a timepiece oscillator mechanism including at least one inertial mass cooperating with an elastic return means for maintaining the oscillation and defining the oscillation frequency, and including at least one such adjustment mechanism for adjusting at least one bridge carrying means for the pivotal guidance of said at least one inertial mass.

The invention also relates to a timepiece movement including at least one such timepiece oscillator mechanism, and/or at least one such adjustment mechanism.

The invention also relates to a timepiece, in particular a watch, including at least one such timepiece movement, and/or at least one such timepiece oscillator mechanism, and/or at least one such adjustment mechanism.

The invention relates to the field of geometric adjustment settings for timepiece components, the position of which determines the chronometric precision of a timepiece.

BACKGROUND OF THE INVENTION

In watchmaking, adjusting the clearances of the movable components is a constant preoccupation, amplified by the fact that, in a watch, such components may occupy all the positions in the field of gravity.

The adjustment of the clearance of the balance assumes major importance for the precision of the oscillator.

The balance clearance is traditionally adjusted by bending the balance bridge, or by moving the shock absorbers, which is firstly difficult to quantify and secondly difficult to reverse in the case of adjustment by deformation.

Another possibility consists in integrating one or more adjustment screws under the support/supports of the balance bridges. Though deformation of the bridge is thus avoided, precise location remains inconvenient, and the play particular to the screws also has to be taken into account.

The document CH714379A in the name of Richemont describes a set of clockwork frame elements, comprising a plate, a bridge, a screw foot mounted on the plate, an intermediate ring cooperating by screwing with this screw foot and having a first positioning surface against which the bridge bears, a clamping means cooperating with the screw foot and arranged to press the bridge against the support surface in order to connect the bridge to the plate. The first positioning surface is defined by a rim that the intermediate ring includes, the screw foot includes a tube extending in the direction of the bridge, and the intermediate ring includes an axial opening defining a guide surface cooperating with the external periphery of the clamping means.

SUMMARY OF THE INVENTION

The invention consists in replacing the adjustment screws by components in the form of a bow with double or even triple steps (for example 2×180° or 3×120°), smooth or notched. The variant with the use of notched steps has the advantage of making it possible to feel the number of steps made, and to quantify the extent of modification of the clearance. In the case of the smooth variants, functioning with friction, it is the angle that indicates the movement and modification of the clearance.

Thus the invention relates to a mechanism for adjusting a timepiece bridge fixed to a structure, according to claim 1.

The invention also relates to a timepiece oscillator mechanism including at least one inertial mass cooperating with an elastic return means for maintaining the oscillation and defining the oscillation frequency, and including at least one such adjustment mechanism for adjusting at least one bridge carrying means for the pivotal guidance of said at least one inertial mass.

The invention also relates to a timepiece movement including at least one such timepiece oscillating mechanism, and/or at least one such adjustment mechanism.

The invention also relates to a timepiece, in particular a watch, including at least one such timepiece movement, and/or at least one such timepiece oscillator mechanism, and/or at least one such adjustment mechanism.

BRIEF DESCRIPTION OF THE DRAWINGS

Other features and advantages of the invention will emerge from reading of the following detailed description, with reference to the accompanying drawings, wherein.

DETAILED DESCRIPTION OF PREFERRED EMBODIMENTS

Figure 1:
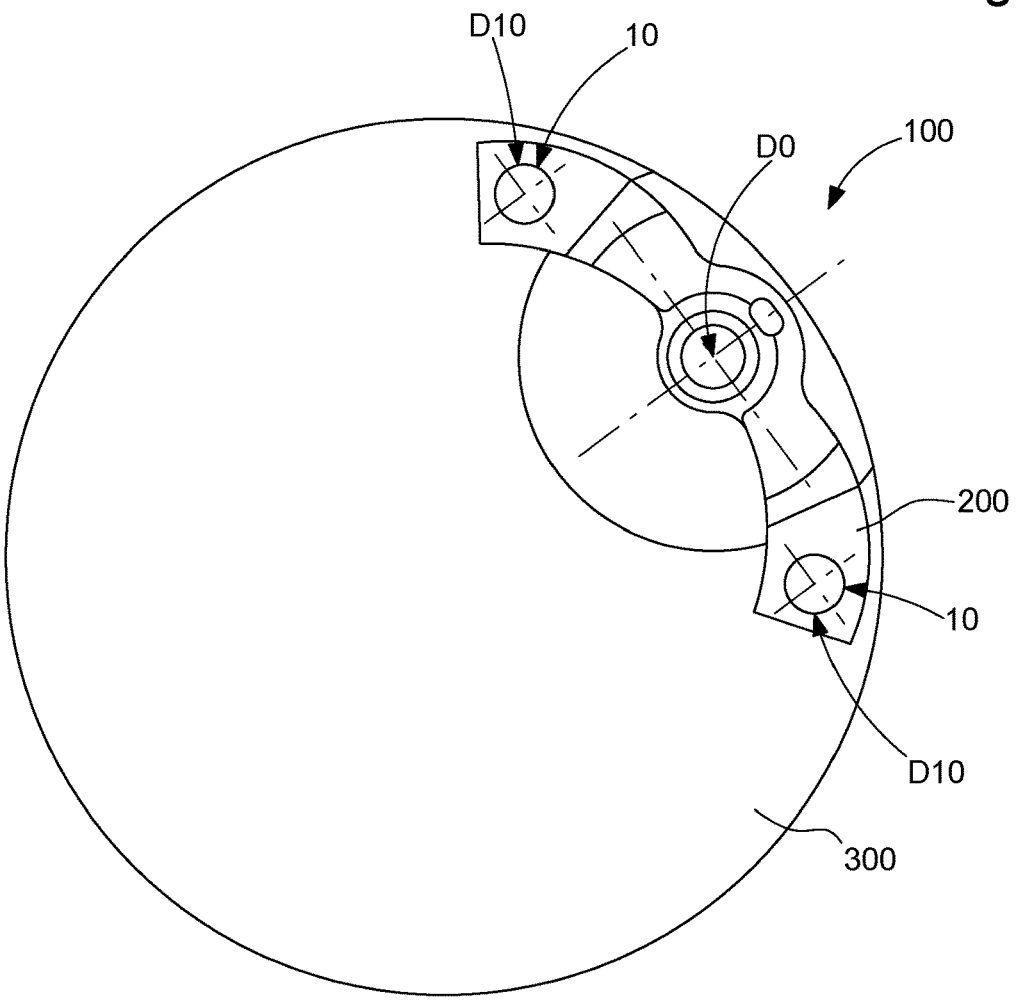
FIG. 1 shows, in a schematic and simplified fashion, and in plan view, a watch including a movement with a balance-spring oscillator, only the balance bridge of which is shown, fixed to a structure formed by the plate of the watch at two points at the ends of this bridge, where two adjustment mechanisms according to the invention are installed.
Figure 8:
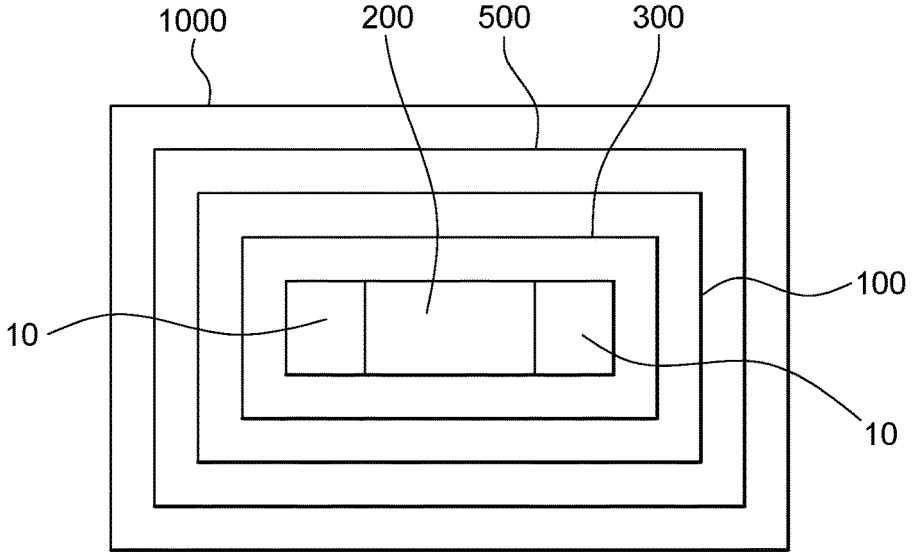
FIG. 8 is a block diagram that shows a timepiece, in particular a watch including a movement with a spiral-balance oscillator, including a balance bridge and two mechanisms for adjusting this bridge with respect to a structure.

The invention relates to a mechanism 10 for adjusting a timepiece bridge 200 fixed to a structure 300.

The invention is illustrated in the figures, in a particular and non-limitative fashion, for adjusting a bridge 200, which is a balance bridge, with respect to a watch plate constituting such a structure 300.

This adjustment mechanism 10 includes, coaxial and able to move one with respect to the other by sliding along a common axis D10 and/or in rotation with respect to this axis D10, which defines the adjustment direction, and returned one towards the other by an elastic return means or pressed one against the other by a clamping means, a first component 1 that is arranged so as to be fixed to the structure 300 or to the bridge 200, and at least one second component 4 that is arranged so as to be fixed to the bridge 200 or respectively to the structure 300.

According to the invention, the first component 1 includes, on a first annular or circular sector around the axis D10, a first relief 3 or 7 facing a second relief 6 or 8 that the second component 4 includes on a second annular or respectively circular sector around the same axis D10. This first relief 3 or 7 and this second relief 6 or 8 have variable cooperation depending on the relative angular position between the first component 1 and the second component 4. Each particular relative angular position defines a particular distance between reference surfaces S1 and S2, perpendicular to the axis D10, of the first component 1 and of the second component 4, which are for example the planar ends thereof, opposite to each other, in the non-limitative case of the figures.

Advantageously, the arrangement of the first relief 3 or 7 and of the second relief 6 or 8 is intended to allow a sensitive adjustment for the horologist making the clearance adjustment, and to enable it to return backwards, which the usual deformation of the bridge does not allow. This sensitive adjustment may be related to jumps, in particular with regard to passing notches, or going up or down steps, and/or friction.

More particularly, and according to advantageous embodiments illustrated by the figures:

either the first relief 3 or 7 and the second relief 6 or 8 each include a friction surface able to maintain a stable relative angular orientation between the first component 1 and the second component 4 when they are pushed one towards the other in an infinity of possible positions, each relative angular orientation then giving rise to a particular distance between the reference surfaces S1 and S2, which is different from other distances corresponding to other particular positions. More particularly again, each relative angular orientation gives rise to a particular distance H between the reference surfaces S1 and S2, which is different from all the other distances corresponding to all the other particular positions.

or the first relief 3 or 7 and the second relief 6 or 8 are arranged to guide the first component 1 and the second component 4 in an additional relative rotation towards the stable position from a finite number of stable equilibrium positions when they are pushed one towards the other, each such stable position corresponds to a particular distance between the reference surfaces S1 and S2, among a finite number of possible distances. More particularly again, each relative angular orientation causes a unique particular distance H between the reference surfaces S1 and S2, which is different from all the other distances corresponding to all the other particular positions.

Figure 5:
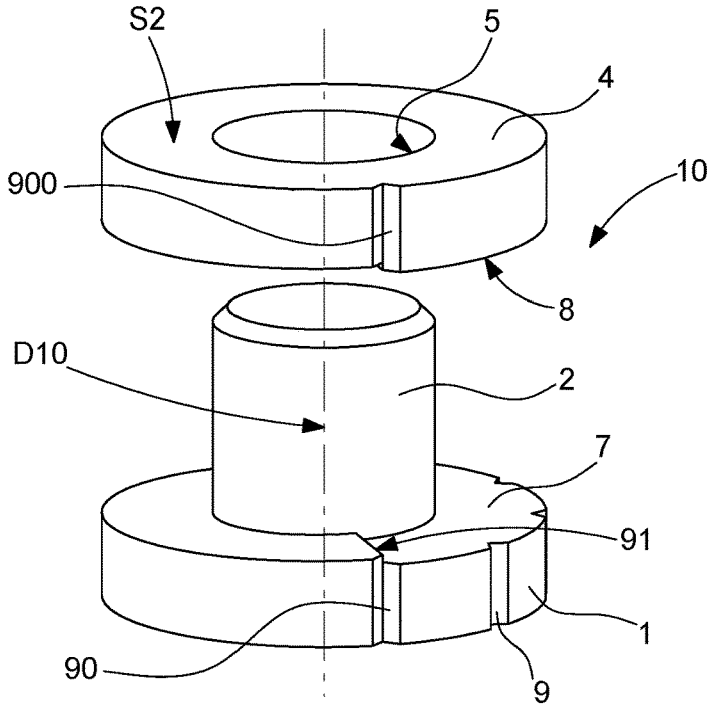
FIG. 5 shows, schematically and in exploded perspective, a second variant of such an adjustment mechanism, including a first component and a second component mounted coaxial and able to move angularly and axially with respect to each other, one being fixed to the bridge and the other to the plate, or vice versa; this first component and this second component each include a relief turned towards another relief on the other component, these reliefs being arranged to cooperate with each other by friction, but not necessarily being strictly complementary, each relative angular position between the two components corresponding to a particular axial distance between the reference surfaces, of the stack formed by this first component and this second component; here the reliefs of the two components are in a helix with a very small pitch, on an annular track, each helix terminating in a straight edge; the figure shows marks made on the external cylindrical diameter that each of the components includes, a numerical marking, or other, may be added, and is not shown in order not to burden the figure; this figure also shows the cylindrical-type guidance of the two components with respect to each other.
Figure 6:
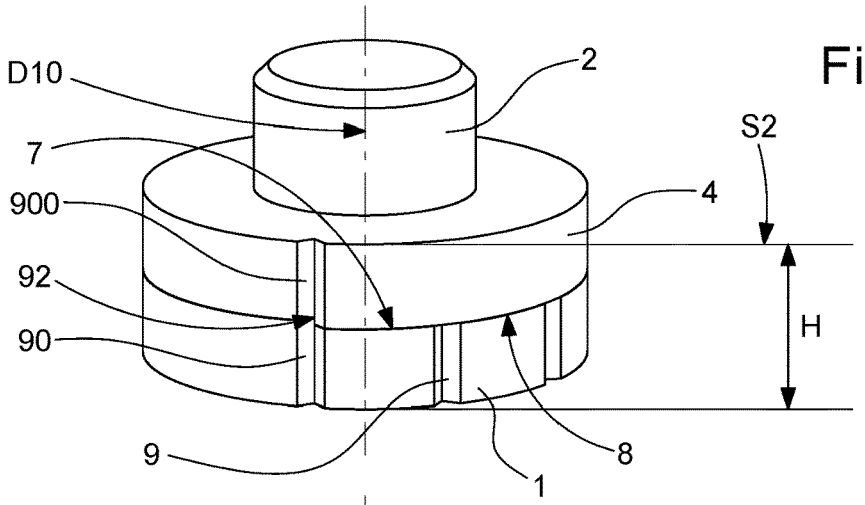
FIG. 6 shows, schematically and in elevation, the mechanism in FIG. 5, in a minimum-distance position, where the straight edges of the helix profiles touch.
Figure 7:
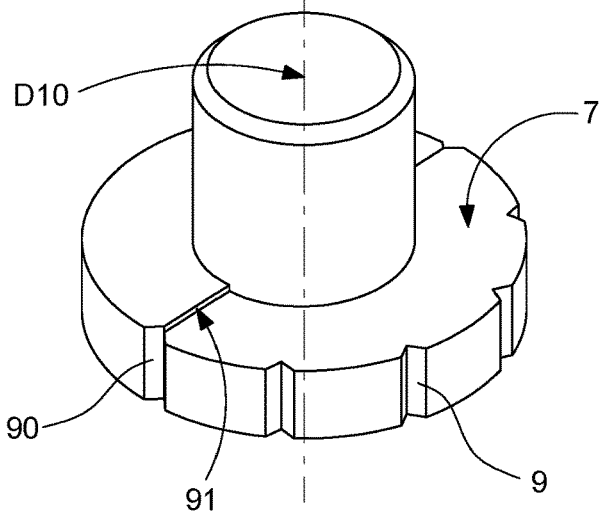
FIG. 7 shows, schematically and in perspective, the single first component of the mechanism in FIG. 5, and shows the helix profile thereof, which includes a friction surface that can be finished with a particular roughness, and/or a surface treatment intended to increase friction.

With regard to the friction variant, FIGS. 5 to 7 illustrate the case where, in the adjustment mechanism 10, the first relief 7 and the second relief 8 each include a friction surface able to maintain a stable relative angular orientation between the first component 1 and the second component 4 when they are pushed one towards the other, in an infinity of possible positions, each relative angular orientation giving rise to a distance that is different from the distances corresponding to the other particular positions.

In these FIGS. 5 to 7, the first component 1 and the second component 4 each include a relief 7, 8, turned towards another relief 8, 7, on the other component, these reliefs being arranged to cooperate with each other by friction, but not necessarily being strictly complementary. Each relative angular position between the two components 1 and 4 corresponds to an axial distance H between the reference surfaces S1, S2, particular to the stack formed by this first component and this second component. In these figures the reliefs 7 and 8 of the two components 1 and 4 are in a helix with a very small pitch, on an annular track, each helix terminating in a straight edge 91, 92. Marks 9, 90, 900 are made on the external cylindrical diameter that each of the components includes, a numerical marking, or other, may also be added, the marks 90 and 900 correspond to the location of the edges 91 and 92. In this example there exists a cylindrical-type guidance between two surfaces 2, 5, of the two components 1 and 4 with respect to each other.

Figure 2:
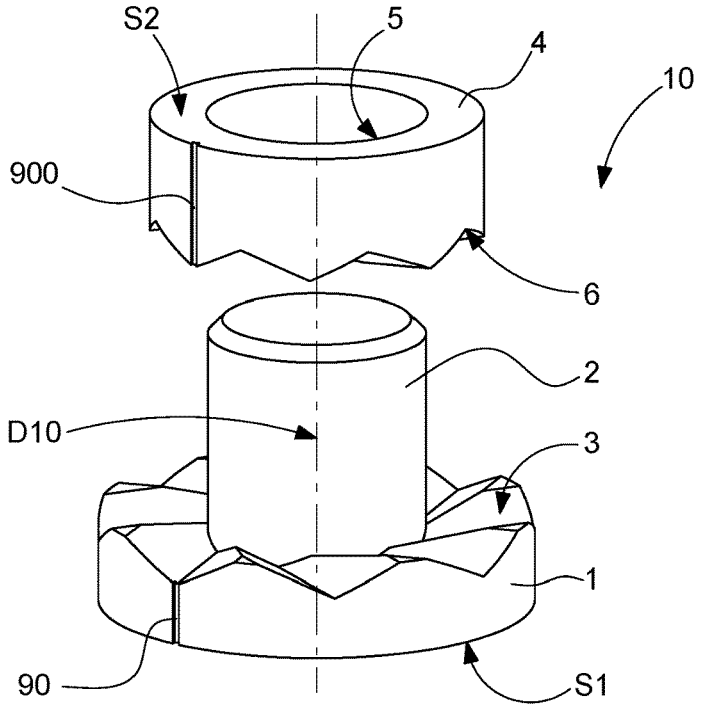
FIG. 2 shows, schematically and in exploded perspective, a first variant of such an adjustment mechanism, including a first component and a second component mounted coaxial and able to move angularly and axially with respect to each other, one being fixed to the bridge and the other to the plate, or vice versa; this first component and the second component each including a relief turned towards another relief of the other component, these reliefs not necessarily being complementary, and being arranged to adopt with each other a certain number of combinations of discrete positions, each resulting in a particular axial distance between the reference surfaces of the stack formed by this first component and this second component, each of the combinations corresponding to a different distance; the figure shows marks made on the external cylindrical diameter that each of the components includes, a numerical marking, or other, can be added, and is not shown in order not to burden the figure; this figure also shows the guidance of the cylindrical type of the two components with respect to each other.
Figure 3:
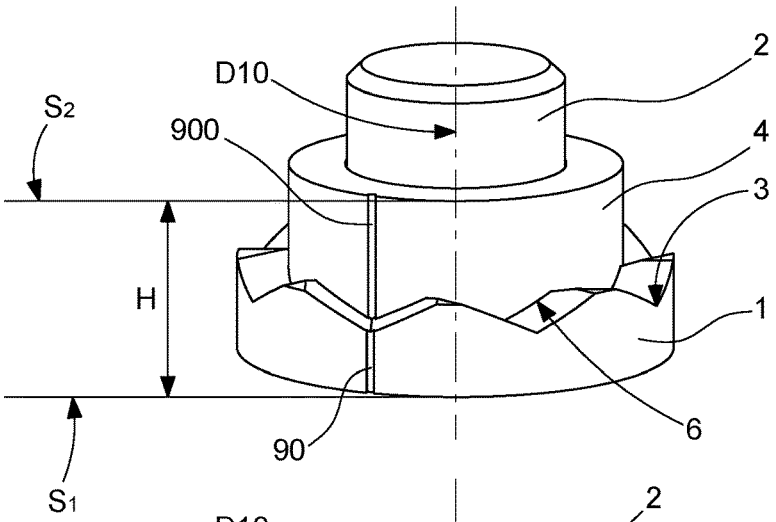
FIG. 3 shows, schematically and in elevation, the mechanism of FIG. 2, and shows the first crenellated or toothed relief, on an annular sector, that this first component includes, and the cooperation thereof with a second crenellated or toothed relief of the second component.
Figure 4:
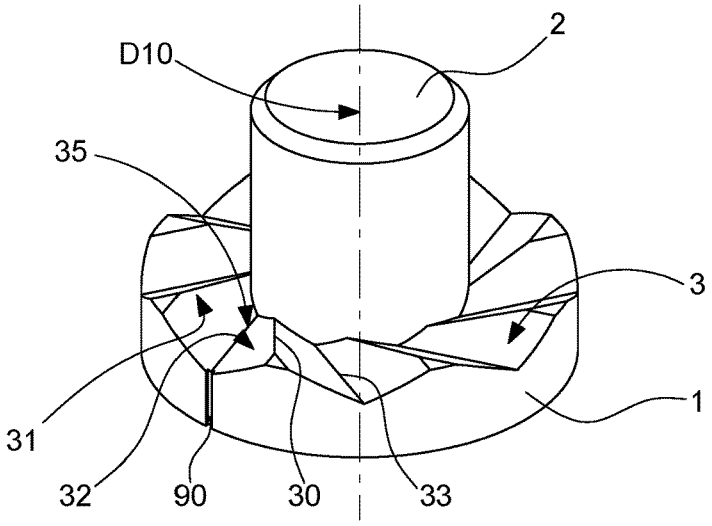
FIG. 4 shows, schematically and in perspective, the single first component of the mechanism in FIG. 2; this figure shows that the toothed crenellations that it includes have different tooth heights, and/or different tooth bottom heights, and/or variable amplitude, and extend between distinct axial levels; in this particular embodiment the tooth ridges and the tooth bottoms are not radial with respect to the common axis of the two components.

With regard to the variant with discrete positions, several embodiments are possible. The embodiment with notches, a crenellation or teeth makes it possible to clearly separate the positions, to give the horologer clear information on change of position. Advantageously the reliefs 3 and 6 are arranged so as to propose a range of a plurality of different distances H, and preferably obtained in an increasing order when the relative rotation between the first component 1 and the second component 4 is made in a single rotation direction. Advantageously, at least one relief 3, 6, and more particularly each relief 3, 6, is of the helical steps type, with a sloped surface enabling the step to be changed in both rotation directions; each step may be substantially flat, or hollow, as in FIGS. 2 to 4 wherein each level corresponds to a dihedron guaranteeing good adjustment stability, and preventing disturbance under the effect of vibrations or shocks during the life of the watch. These FIGS. 2 to 4 illustrate the case where, in the adjustment mechanism 10, the first relief 3 and the second relief 6 are arranged to guide the first component 1 and the second component 4 in an additional relative rotation to a stable position among a finite number of stable equilibrium positions when they are pushed one towards the other, where each stable position corresponds to a single particular distance among a finite number of possible distances between said reference surfaces. These reliefs 3 and 6 are not necessarily complementary, and are arranged to adopt with each other a certain number of combinations of discrete positions, each resulting in a particular axial distance H between the reference surfaces S1 and S2 of the stack formed by this first component 1 and this second component 4, each of the combinations corresponding to a different distance. Marks 90, 900 are made on the external cylindrical diameter that each of the components includes, a numerical marking, or other, may also be added. In this example there exists a guidance of the cylindrical type between two surfaces 2, 5, of the two components 1 and 4 with respect to each other. FIG. 4 shows, at the bottom part, a first female edge 33 of a first hollow dihedron corresponding to a first staircase step, a slope leads to a high point formed by a male edge 30 constituting a tight spot to be crossed when changing adjustment, a second dihedron includes a second female edge 35, delimited by two oblique faces 31 and 32, this second female edge 35 is at a altitude different from that of the first female edge 33, and so on. It will be understood that it is possible to further increase the number of adjustment positions with a first component 1 and a second component 4 having different numbers of edges, and in particular numbers prime with each other.

The invention also relates to a timepiece oscillator mechanism 500 including at least one inertial mass cooperating with an elastic return means for maintaining the oscillation and definition of the oscillation frequency, and including at least one such adjustment mechanism 10 for adjusting at least one bridge 200 carrying means for the pivotal guidance of this at least one inertial mass.

The invention also relates to a timepiece movement 500 including at least one such timepiece oscillator mechanism 100, and/or at least one such adjustment mechanism 10.

The invention also relates to a timepiece, in particular a watch, including at least one such timepiece movement 500, and/or at least one such timepiece oscillator mechanism 100, and/or at least one such adjustment mechanism 10.

The invention has the advantage of simple mechanical adjustment of the clearance.

The arrangement particular to the invention makes it possible to control the geometry of the supports (in particular endstones) and to keep the balance parallel to the plate. For simple adjustment of the clearance, it is necessary to size the system so as to have the balance shaft very slightly constrained through the endstones and the springs of the shock absorber. By angularly moving one of the two components (the other being fixed, on the plate or the bridge) continuously, the balance will be moved as soon as a clearance is present.

The invention claimed is:

1. A mechanism (10) for adjusting a timepiece bridge (200) fixed to a structure (300), said adjustment mechanism (10) comprising, coaxial and movable one with respect to the other by sliding along a common axis (D10) and/or in rotation with respect to said axis (D10), which defines the adjustment direction, and returned one towards the other by an elastic return means or pressed one against the other by a clamping means, a first component (1) arranged so as to be fixed to said structure (300) or to said bridge (200), and at least one second component (4, 8) arranged so as to be fixed to said bridge (200) or respectively to said structure (300), wherein said first component (1) includes, on a first annular or circular sector around said axis (D10), a first relief (3, 7) facing a second relief (6) that said second component (4, 8) includes on a second annular or respectively circular sector around said axis (D10), said first relief (3, 7) and said second relief (6) having variable cooperation depending on the relative angular position between oblique surfaces, relative to said axis (D10), of each of said first component (1) and said second component (4, 8), said oblique surfaces being angled so as to rest flatly on ones of each other, each said particular relative angular position defining a particular distance H in an increasing order along an entire circumference about said axis (D10) and between reference surfaces (S1, S2) perpendicular to said axis (D10) of said first component (1) and of said second component (4, 8), wherein said first relief (3, 7) and said second relief (6) are arranged to guide said first component (1) and said second component (4, 8) in an additional relative rotation towards a stable position among a finite number of stable equilibrium positions when they are pushed one towards the other, and in that each said stable position corresponds to a particular distance among a finite number of possible distances between said reference surfaces (S1, S2).

2. The adjustment mechanism (10) according to claim 1, wherein each relative angular orientation gives rise to a unique particular distance H between the reference surfaces (S1, S2), which is different from all the other distances corresponding to all the other particular positions.

3. The adjustment mechanism (10) according to claim 1, wherein said first relief (3, 7) and said second relief (6) each include a friction surface able to maintain a stable relative angular orientation between said first component (1) and said second component (4, 8) when they are pushed one towards the other.

4. A timepiece oscillator mechanism (100) including at least one inertial mass cooperating with an elastic return means for maintaining the oscillation and the definition of the oscillation frequency, and including at least one adjustment mechanism (10) according to claim 1, for adjusting at least one bridge carrying means for the pivotal guidance of said at least one inertial mass.

5. The timepiece movement (500) including at least one timepiece oscillator mechanism (100) according to claim 4, and/or at least one adjustment mechanism (10) according to claim 1.

6. The timepiece (1000) including at least one timepiece movement (500) according to claim 5.

7. The timepiece (1000) according to claim 6, wherein said timepiece (1000) is a watch.

8. The timepiece (1000) including at least one timepiece oscillator mechanism (100) according to claim 4.

9. Timepiece (1000) including at least one adjustment mechanism (10) according to claim 1.

10. The adjustment mechanism (10) according to claim 1, wherein said oblique surfaces are arranged in pairs of male and female dihedron shapes of each of same first component (1) and said second component (4, 8).

11. The adjustment mechanism (10) according to claim 10, wherein ones of said dihedron shapes are irregularly arranged around said axis (D10) such that heights of edges of said dihedron shapes differ from each other along said axis (D10).

12. The adjustment mechanism (10) according to claim 1, wherein said oblique surfaces of each of said first component (1) and said second component (4, 8) are arranged in pairs of helices that rest at least partly flatly on ones of each other around said axis (D10), and wherein a height of each of the helices individually is smoothly increased along a half of the entire circumference about said axis (D10).

* * * * *